United States Patent [19]

Robb et al.

[11] Patent Number: 5,003,642

[45] Date of Patent: Apr. 2, 1991

[54] FOREIGN MATTER TRAP FOR SHOWER DRAIN

[76] Inventors: Wendell E. Robb, 3204 S. 85th E. Ave., Tulsa, Okla. 74145; William S. Hudson, R.R. 2, Box 3, Lawrence, Kans. 66044

[21] Appl. No.: 866,983

[22] Filed: May 14, 1986

Related U.S. Application Data

[63] Continuation of Ser. No. 734,801, May 15, 1985, abandoned, which is a continuation of Ser. No. 499,284, May 31, 1983, abandoned.

[51] Int. Cl.[5] ..... A47K 1/14; E03C 1/26

[52] U.S. Cl. ..... 4/287; 210/164; 4/292

[58] Field of Search ..... 4/286–292, 4/DIG. 14; 210/137, 163, 164, 336, 483

[56] References Cited

U.S. PATENT DOCUMENTS

| | | | |
|---|---|---|---|
| 214,983 | 5/1879 | Atwater | 4/287 |
| 824,487 | 6/1906 | Klein | 210/484 |
| 1,640,198 | 8/1927 | Lobit | 210/483 |
| 1,935,128 | 11/1933 | Pullman | 4/DIG. 14 |
| 2,068,406 | 1/1937 | Freed | 4/DIG. 14 |
| 3,959,831 | 6/1976 | Hendricks | 4/DIG. 14 |
| 4,199,827 | 4/1980 | Tuleja | 4/289 |
| 4,209,394 | 6/1980 | Kelland | 210/336 |
| 4,230,582 | 10/1980 | Tuleja | 4/292 |

*Primary Examiner*—Charles E. Phillips
*Attorney, Agent, or Firm*—Head & Johnson

[57] ABSTRACT

A foreign matter trap for use in a drain such as a shower or sink drain in which water flows downwardly through a drain pipe, the trap having an element for removably positioning in the drain pipe including a downwardly extending longitudinal member, a plurality of layers of foreign matter catching members extending generally radially from the longitudinal member, each layer being formed of a plurality of spaced apart spicule members, the spicule members of each layer covering less than a complete cross-sectional circumferential area leaving a portion free for the flow of water therepast, the layers being arranged so that the spicule members in adjacent upper layers extend over and above the free cross-sectional areas of the next lower layer so that water may continue to flow through the drain even when the spicule members of any layer are completely closed by trapped foreign matter.

11 Claims, 4 Drawing Sheets

FOREIGN MATTER TRAP FOR SHOWER DRAIN

This is a continuation application of Ser. No. 734,081, filed May 15, 1985, which was a continuation application of Ser. No. 499,284 filed on May 31, 1983 both now abandoned.

SUMMARY OF THE INVENTION

A major expense of maintaining residential buildings, including particularly dormitories wherein a large number of people utilize the plumbing facilities, is that of preventing drains, such as shower drains, lavatories, and the like from being clogged with foreign matter, particularly hair. Due to the propensity of hair to collect in drains and the fact that it is very slow to deteriorate, it is a primary cause of clogged drain areas in plumbing systems. If the clogged areas are close to an accessible opening they can usually be unstopped by the application of plumbing tools. In some instances the clogged areas may occur at remote positions in a plumbing system making them difficult and time consuming to unstop.

The present invention is directed toward an apparatus for collecting foreign matter, such as hair, adjacent a drain in a shower or lavatory so that the foreign matter can be expeditiously removed on a periodic basis to thereby prevent it from accumulating and clogging the drain system, in remote areas where clearing the stoppage can be exceedingly difficult.

Others in the past have provided brush-type apparatus for positioning in drains for catching foreign matter, but the difficulty with these apparatus is that after they collect sufficient foreign matter they clog up and prevent the flow of water therethrough, causing the drain to malfunction. This can cause water to back up and overflow a shower, sink or other apparatus and thereby cause substantial water damage.

The present invention is directed toward a foreign matter trap for use in a drain which is designed to have maximum effectiveness and efficiency in collecting foreign matter but in an arrangement wherein the drain will not be blocked to cause water to back up even in spite of its improved effectiveness and efficiency.

In order to achieve this result the foreign matter trap includes an element removably positioned in a drain pipe having a downwardly extending longitudinal member which may be of a variety of configurations. The longitudinal downwardly extending member has plurality of layers of foreign matter catching members extending generally radially therefrom. Each layer is formed of a plurality of spaced apart spicule members. The outer ends of the spicule members are either in engagement with the drain pipe in which the trap is positioned or are in close proximity to the internal circumferential surface of the drain pipe. The spicule members are arranged generally parallel to and adjacent each other and spaced close enough together to entrap foreign matter.

Each layer of spicule members is arranged so that an opening or passageway is provided wherein no spicule members exist. That is, the spicule members of each layer cover less than a complete cross-sectional circumferential area of the drain pipe in which they are positioned. The layers are arranged so that the spicule members in each adjacent upper layer extend over and above the cross-sectional areas of the next lower layer free of spicule members. In this manner water may continue to flow past each layer and through the areas which do not have spicule members so that if the spicule members in each layer are completely filled with foreign matter nevertheless the drain is not blocked.

By utilizing the foreign matter trap of this invention a periodic maintenance schedule wherein the traps are removed and cleaned, foreign matter will be captured and removed before it has an opportunity to pass to a remote or inaccessible area of the plumbing system. At the same time, the possibility of the drain being blocked causing water to overflow is eliminated.

The invention includes embodiments which are particularly adaptable for inexpensive plastic molding procedures and wherein the trap may be formed as a disposable device which can easily be removed from the plumbing element which supports it. In this manner a maintenance worker can expeditiously remove used foreign matter traps and replace them with new ones without the time and expense of cleaning such traps.

BRIEF DESCRIPTION OF THE DRAWING

In FIGS. 6 and 7 the longitudinal members are pivotally supported to a drain opening cover.

DETAILED DESCRIPTION OF THE PREFERRED EMBODIMENT

Figure 1:
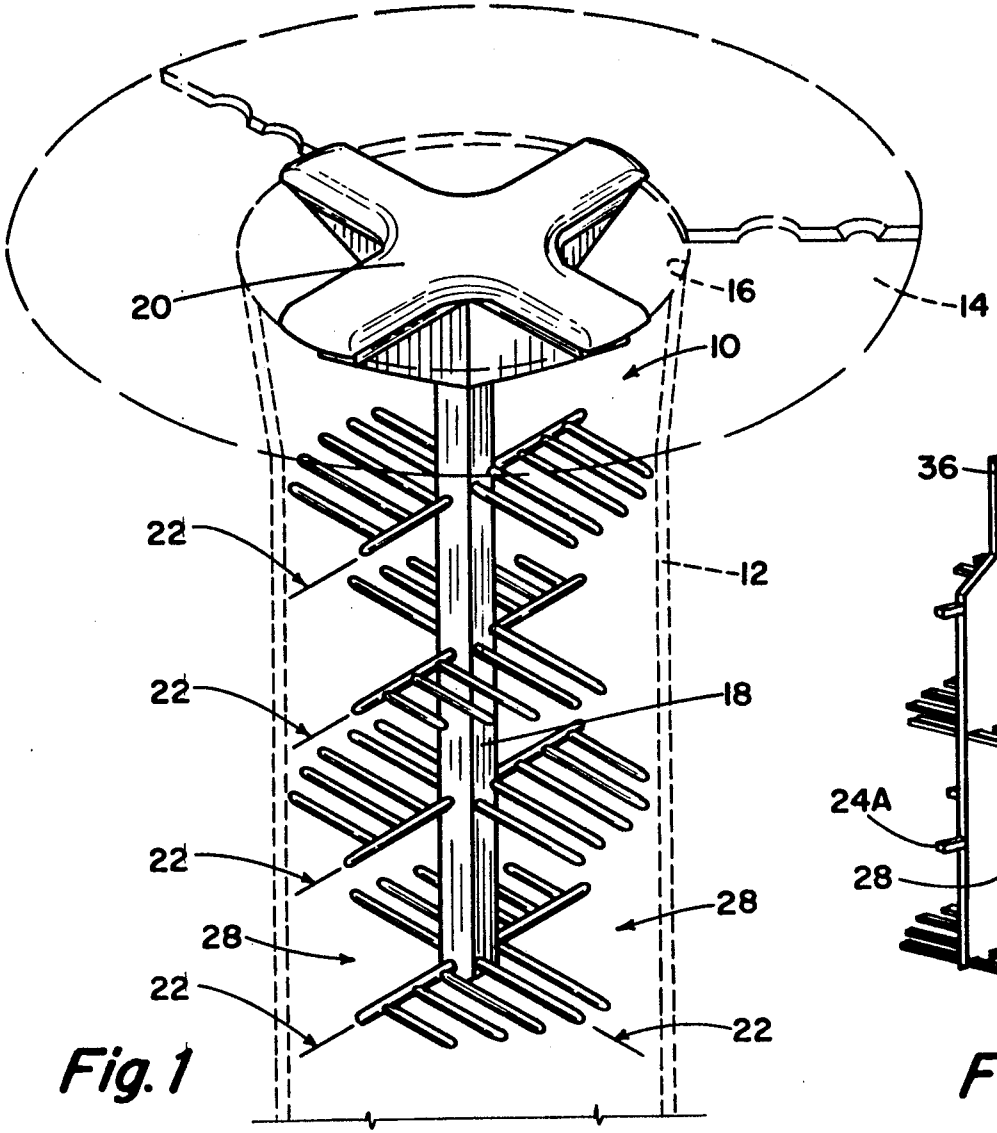
FIG. 1 is an isometric view of one embodiment of the invention showing a foreign matter trap positioned in a drain, such as in a shower or lavatory, the drain being shown in dotted outline.

Referring now to the drawings and first to FIGS. 1 through 5, an embodiment of the invention is illustrated. FIG. 1 shows the foreign matter trap generally indicated by the numeral 10 positioned in a drain pipe 12 which is typically connected with a floor plate 14 if the drain is in a shower or to a similar plumbing apparatus if it is in a lavatory. The plate 14 has an opening 16 therein through which water drains from a shower, lavatory or the like and is carried away in the building plumbing system. The present invention is directed towards an apparatus for capturing foreign matter, and particularly hair, adjacent the opening 16 so as to prevent it from becoming lodged in some remote and more inaccessible location. The foreign matter trap 10 includes a trap element positionable within the drain pipe 12 having a downwardly extending longitudinal member 18. The upper end of the longitudinal member 18 is secured to a top member means 20 which is configured to engage a portion of plate 14 at the opening 16 so that the longitudinal member 18 is vertically supported in drain pipe 12 and will not be further downwardly displaced.

Figure 4:
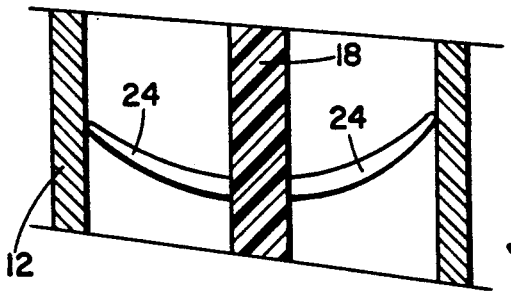
FIG. 4 is a partial elevational view showing the arrangement of a trap in which the spicule members are of length so that when the trap is positioned within a drain pipe the spicule members are bent.

Affixed to and extending from the longitudinal member 18 are a plurality (four being shown) of layers 22 of foreign matter catching members. The layers 22 are spaced apart from each other, and each layer consists of a plurality of spaced apart spicule members 24. Each of the spicule members are slender rod-like elements, whether round, square or otherwise in cross-sectional configuration. The spicule members are spaced apart from each other a distance so as to effectively impede and entrap foreign matter contained in water passing between them. The outer ends 26 of the spicule members are either in close proximity to or in engagement with the drain pipe 12 in which they are positioned. In FIG. 4 the spicule members 24 are dimensioned so that they are bent as the foreign matter trap is inserted into the drain pipe. This serves to retain the foreign matter trapped in a selected position in the drain pipe.

The spicule members 24 in each layer 22 cover less than a complete cross-sectional circumferential area of the drain pipe, leaving, in each layer, at least one opening 28. As shown in FIGS. 1, 3A, 3B and 3C, each layer 22 provides spicule members arranged in such a way that two openings 28 are provided. This permits water to flow past each layer 22 even if the closely spaced-apart spicule members are completely clogged by entrapped foreign matter.

As shown in FIG. 1, each layer 22 is arranged so that the spicule members in adjacent upper layers extend over and above the open cross-sectional areas 28 of the next lower layer. Thus if water passes downwardly in a vertical path through all four layers 22, it will pass through two areas of closely spaced adjacent spicule members. However, if these closely spaced spicule members become clogged with foreign matter so that water cannot pass through, water can continue to flow through the drain pipe by following a circuitious route, passing freely through the opened areas 28 in each layer 22. By this means, the foreign matter trap is exceedingly effective in entrapping foreign matter but at the same time prevents the foreign matter from ulitmately clogging the trap so that the drain is stopped. It can be appreciated that if a drain is completely stopped, water can back up and overflow the lavatory, shower, or environment with which the drain communicates, causing damage. With the provision of the open area 28 in each layer 22, this possibility is eliminated.

Figure 3C:
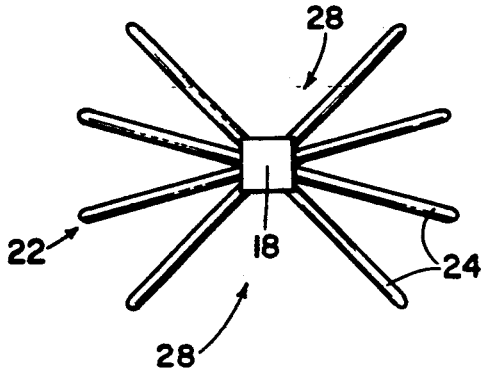
FIG. 3C is a cross-sectional view as in 3A but showing an additional alternate embodiment of the invention.
Figure 3B:
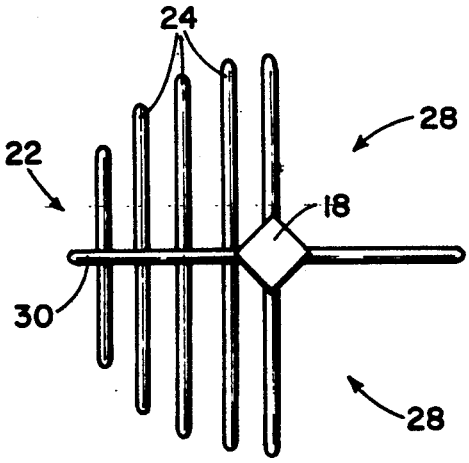
FIG. 3B is a cross-sectional view as in FIG. 3A but showing an alternate arrangement of a layer of spicule members.
Figure 3A:
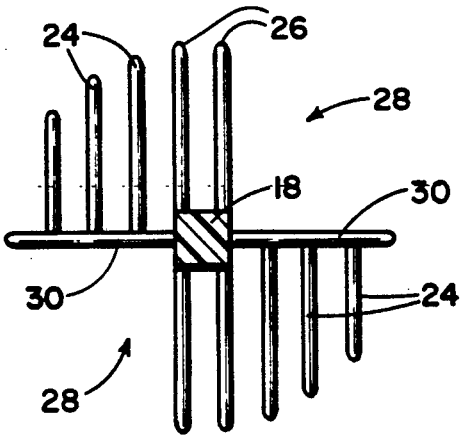
FIG. 3A is a cross-sectional view taken along the line 3—3 of FIG. 2 showing on arrangement for a layer of spicule members.
Figure 7:
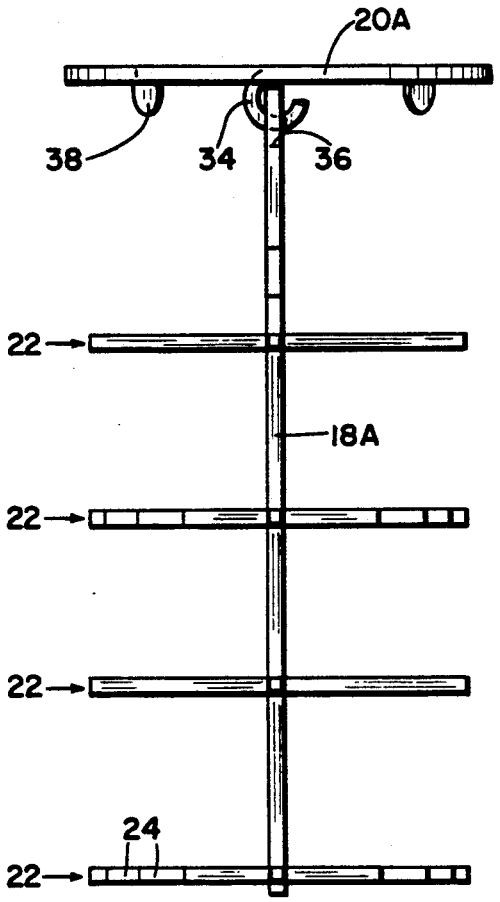
FIG. 7 is a side view of the embodiment of FIG. 6.
Figure 6:
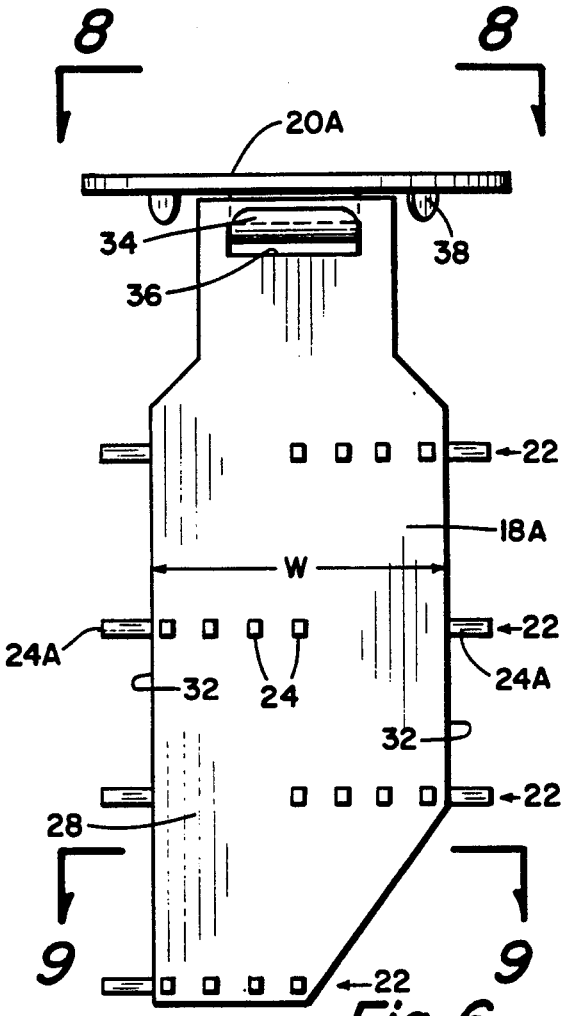
FIG. 6 is an elevational view of an alternate embodiment of the invention wherein the downwardly extending longitudinal members are in the form of a flat sheet.

The spicule members 24 may extend directly from the longitudinal members 18 such as in the design of FIG. 3C. In the design of FIGS. 3A and 3B primary spicule members 30 extend from the longitudinal member 18 having secondary spicule member 24 extending from it. FIGS. 3A, 3B and 3C are exemplary of a variety of different ways in which the layers 22 of the trap may be designed.

Figure 2:
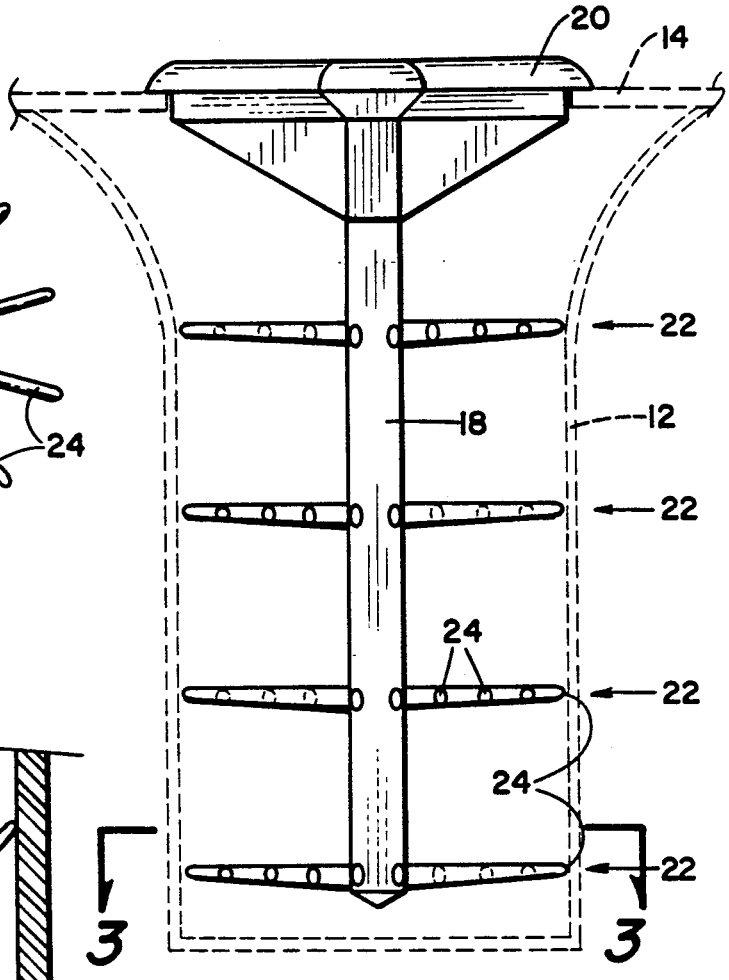
FIG. 2 is an elevational view of the embodiment as shown in FIG. 1.

With the arrangement of FIGS. 1 and 2 a workman can expeditiously remove the trap 10 by pulling upwardly on the top member 20. The trap may then be cleaned by pulling the trapped matter from each of the layers of spicule members or, if the trap is inexpensively constructed, (it can be formed of molded plastic) it can be discarded and replaced. This maintenance procedure can be exceedingly expeditiously performed and if done on a routine basis will serve to capture foreign matter which might ultimately collect and clog a plumbing system in some remote and inaccessible area.

Figure 5:
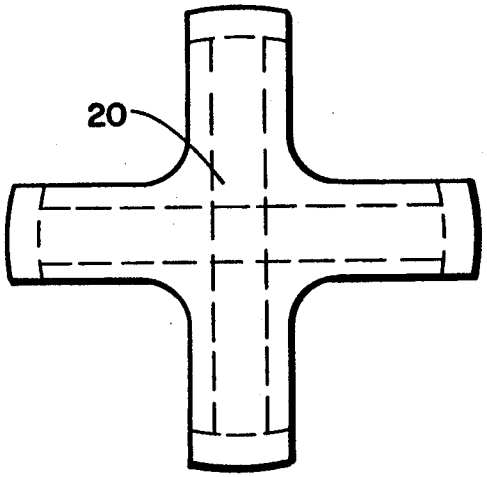
FIG. 5 is a top view of the foreign matter trap of FIG. 1.
Figure 7A:
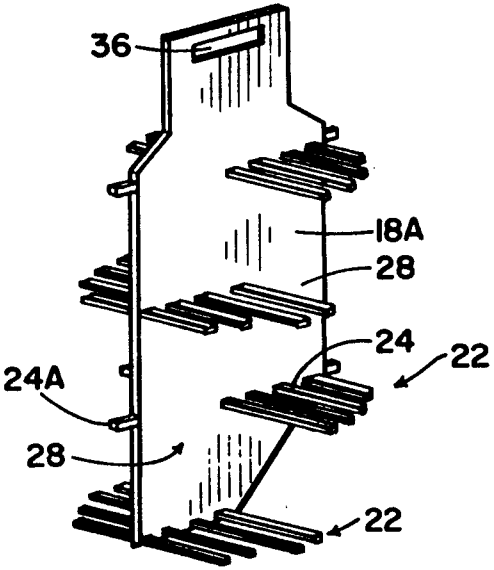
FIG. 7A is an isometric view of the trap longitudinal member as shown in FIGS. 6 and 7.

FIGS. 6 through 9 show an alternate embodiment of the invention. In this embodiment the longitudinal member 18A is in the form of a relatively thin flat sheet of width less than the diameter of the drain pipe in which it is to be positioned. The flat sheet has spicule members 24 extending from it. In the design as illustrated, the width W of the flat sheet longitudinal member 18A is less than the diameter of the drainpipe in which it is positioned so that short length spicule members 24A extend from the opposed edges 32 of the longitudinal member. It can be seen in FIGS. 6 and 7A that each layer 22 of the spicule members is arranged so that the open areas 28 in the next lower layer are below the spicule members in the next above layer for the benefits previously described to ensure effective entrapment of foreign matter but in a manner so that the drain does not become stopped.

Figure 8:
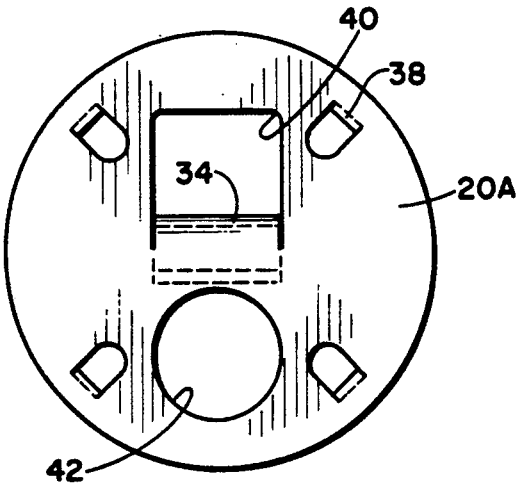
FIG. 8 is a top view of the embodiment of FIGS. 6 and 7 showing the drain opening cover.
Figure 9:
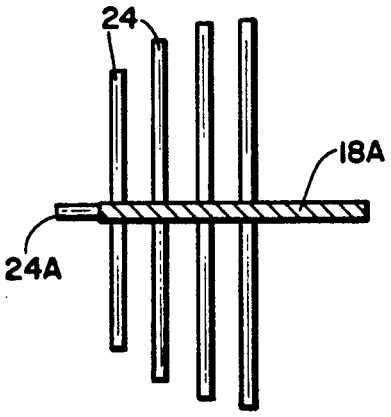
FIG. 9 is a cross-sectional view taken along the line 8—8 of FIG. 6 showing one arrangement of the spicule members.

The top member 20A in this embodiment is in the form of a relatively thin flat plate as best seen in the top view of FIG. 8, having an integrally downwardly extending hinge portion 34. This receives a slot 36 formed in the longitudinal member 18A providing an economical means of interconnecting these elements. The top member 20A may be formed of thin metal or plastic and may be provided with cutouts 38 which are bent downwardly to serve to center top member in a drainpipe, the drainpipe not being shown. In this manner the hinge portion 34 may be formed of a cutout which forms opening 40. For additional area of water flow other openings such as 42 may be provided in the plate 20A.

Figure 10:
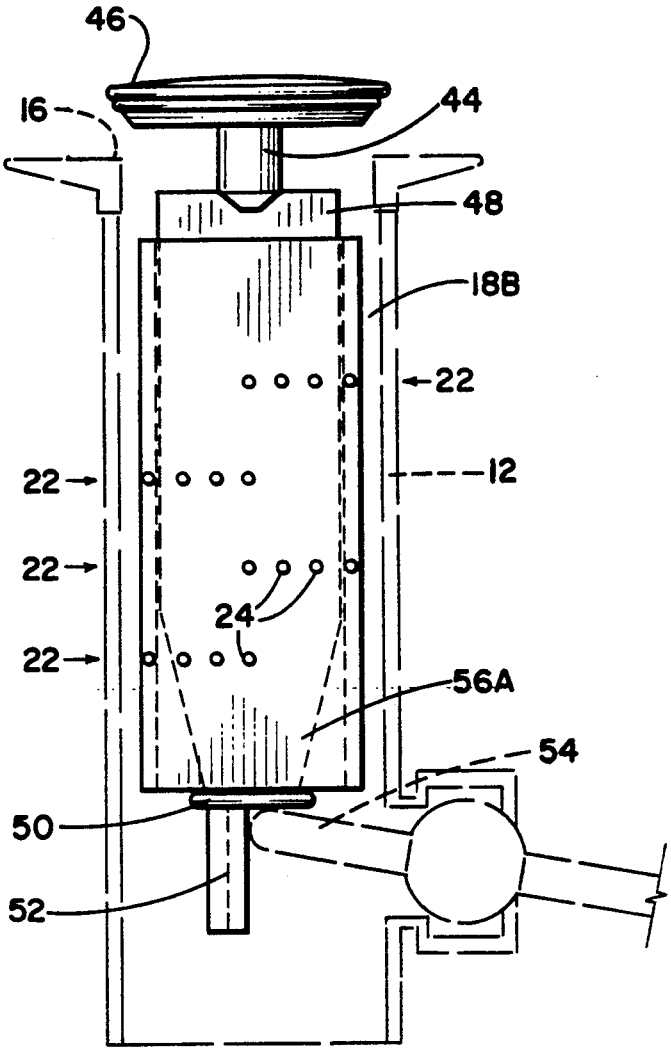
FIG. 10 is an elevational view of an alternate embodiment of the invention in which the foreign matter trap is configured to be employed with a typical lavatory drain plug which can be opened and closed by a remote mechanism, the lavatory drain and drain closure mechanism being shown in dotted outline. The foreign matter trap is shown in solid line.
Figure 13:
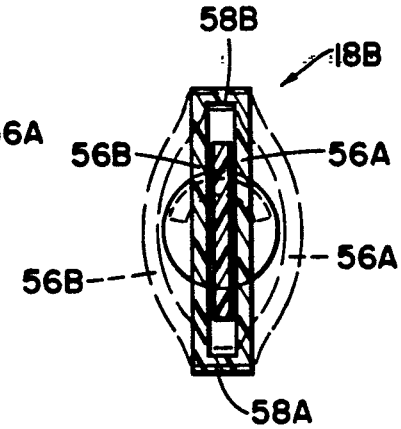
FIG. 13 is a cross-sectional view taken along the line 13—13 of FIG. 11 showing the drain trap in solid outline as it is positioned on a drain plug while in use, and in dotted outline when the sidewalls of the trap are compressed to outwardly expand the sidewalls so that it can be removed from the drain plug. In this manner the device of FIGS. 10 through 13 is particularly adaptable for use as a throwaway type drain trap which does not have to be cleaned.

Many lavatories include stopper elements which are supplied with the lavatories and include remote operating means so that the user can raise or lower the stopper to either entrap water within the lavatory, or permit it to drain out. The embodiments illustrated in FIGS. 10 and 13 are particularly applicable to a lavatory arrangement of this type. Positioned in the drainpipe 12 in FIG. 10 is shown a stopper element 44 of a typical design having an upper circumferential stopper portion 46 which, when in the downward position, closes the opening 16 in the drain allowing water to accumulate in the lavatory. The typical stopper element 44 includes an integral downwardly extending flat portion 48 having, at its lower end, a small horizontal plate 50 and a downwardly extending integral guide 52. A stopper actuator rod 54 which is remotely operated, engages plate 50 to lift the stopper element 44, as shown in FIG. 10, to permit water to drain from the lavatory, or to let it be moved into a lower position so the water will be retained in the lavatory.

The arrangement of the invention in FIGS. 10 through 13 provides a means of utilizing this typically available stopper element 44 for providing a foreign matter trap. In this embodiment the longitudinal member 18B is, as shown in the cross-sectional views of 12 and 13 of a hollow rectangular configuration providing sidewalls 56A and 56B and integral endwalls 58A and 58B. The spicule members 24 extend radially from the sidewalls 56A and 56B. As in the other embodiments, each layer 22 of the spicule members has at least one open area 28. In the illustrated arrangement each layer 22 has two open areas 28. The spicule members overlap the open areas of adjacent lower layers 22 so that water flowing vertically downwardly through the drain pipe 12 must pass through adjacent spicule members; but if these are closed by foreign matter, water can flow by a circuitous route through the drain.

Figure 11:
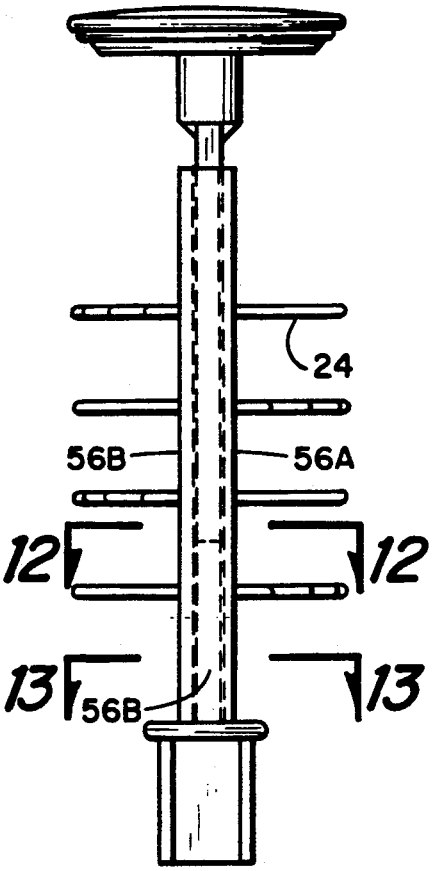
FIG. 11 is a side view of the embodiment in FIG. 10 with the drain not being shown.
Figure 12:
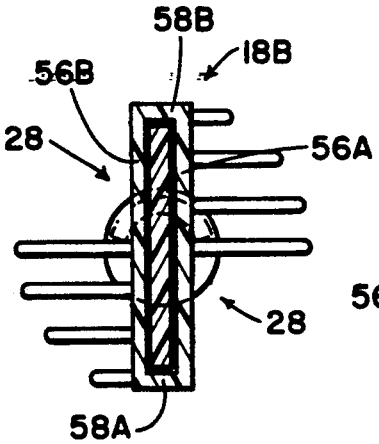
FIG. 12 is a cross-sectional view taken along the line 12—12 of FIG. 11 showing the arrangement of a layer of spicule members on the trap.

An advantage of the arrangement of FIGS. 10 through 13 is the ease of replacement of the trap. Workmen can remove the stopper element 44 by lifting upwardly on the stopper top plate 46; removing the entire device from the drainpipe 12. If the foreign matter trap is filled so that it has become ineffective in entrapping additional foreign matter, it can be replaced by squeezing on the endwalls 58A and 58B to cause the sidewalls 56A and 56B to expand outwardly as shown in dotted outline in FIG. 13. The trap may then be slid downwardly past the plate 50. A new trap may be installed by reversing the process. The design of the trap of FIGS. 11 through 13 is particularly useful when a throwaway type of trap is desired. Since the entire trap may be formed of inexpensive plastic material, the costs can be in the range of a few cents each which makes it impractical, from an economic standpoint, to pay a workman to clean the traps.

The various embodiments of the invention are exemplary of the fact that other arrangements may be employed in praticing the invention which has been set forth herein for purposes of exemplification. It is understood that the invention is not limited to the embodiments set forth herein for descriptive purposes, but is to be limited only by the scope of the attached claim or claims, including a full range of equivalency to which each element thereof is entitled.

What is claimed is:

1. A foreign matter trap for use in a drain, such as a shower or sink drain, in which water flows downwardly through a drain pipe, comprising:

a trap element removably positionable in a drain pipe, the trap element having a downwardly extending substantially straight longitudinal member;

a plurality of discrete, spaced apart, parallel horizontal layers of foreign matter catching members extending generally radially from said longitudinal member, each horizontal layer being in a plane perpendicular to said longitudinal member and formed of a plurality of closely spaced apart spicule members, the outer ends of which are in engagement with or in close proximity to the internal circumferential surface of a drain pipe for which the trap is dimensioned, each horizontal layer having at least one discrete area having many closely spaced spicule members and at least one discrete area devoid of spicule members whereby the spicule members of each layer cover less that a complete cross-sectional horizontal circumferential area leaving a portion of at least about 90° of the drain cross-sectional area free of spicule members, the layers being arranged such that the spicule members in adjacent upper layers extend over and above the cross-sectional area of the next lower layer free of spicule members whereby water may continue to flow through the drain even when the spicule members of each layer are completely closed by trapped foreign matter.

2. A foreign matter trap according to claim 1 wherein said downwardly extending longitudinal member is in the form of a rod shaped member, and wherein each said layer of foreign matter catching members is formed in part, by at least one primary spicule member extending radially from said rod shaped member, and secondary spicule members extending perpendicularly from said primary spicule to form said discrete area having many closely spaced spicule members.

3. A foreign matter trap according to claim 1 wherein said spicules are of such length as to be bent when the foreign matter trap is inserted into a drain pipe.

4. A foreign matter trap according to claim 1 including a top member means at the upper end of said longitudinal member for engaging the upper end portion of a drain, such means including, at least one opening to permit water flow therethrough.

5. A foreign matter trap according to claim 1 wherein said downwardly extending longitudinal member is in the form of a relatively thin flat sheet of width less than the diameter of a drain for which the trap is dimensioned, said spincule members extending radially from both sides of said flat sheet.

6. A foreign matter trap according to claim 1 wherein said downwardly extending longitudinal member is in the form of an envelope having opposed parallel side walls and opposed integral, short length end walls, said spicules extend from both side walls.

7. A foreign matter trap according to claim 6 wherein said envelope may be deformed by pressure applied to said endwalls to expand outwardly said sidewalls to permit the trap to be installed onto or removed from a plumbing apparatus.

8. A foreign matter trap for use in a drain, such as a shower or sink drain, in which water flows downwardly through a drain pipe, comprising:

a trap element removably positionable in a drain pipe, the trap element having a downwardly extending substantially straight longitudinal member;

a plurality of discrete, spaced apart, paralleled layers of foreign matter catching members extending generally radially from said substantially straight longitudinal member, each layer being in a plane perpendicular to said longitudinal member and formed of a plurality of spaced apart spicule members, the outer ends of which are in engagement with or in close proximity to the internal circumferential surface of a drain pipe for which the trap is dimensioned, the spicule members of each layer covering less than a complete cross-sectional circumferential area leaving a portion of a least about 90° of the drain cross-sectional area free of spicule members, the layers being arranged such that the spicule members in adjacent upper layers extend over and above the cross-sectional area of the next lower layer free of spicule members whereby water may continue to flow through the drain even when the spicule members of each layer are completely closed by trapped foreign matter, and wherein said downwardly extending longitudinal member is in the form of a rod shaped member, and wherein each said layer of foreign matter catching members is formed in part, by at least one primary spicule member extending radially from said rod shaped member, and secondary spicule members extending perpendicularly from said primary spicule.

9. A foreign matter trap according to claim 8 wherein said spicules are of such length as to be bent when the foreign matters trap is inserted into a drain pipe.

10. A foreign matter trap according to claim 8 including a top member means at the upper end of said longitudinal member for engaging the upper end portion of a drain, such means including, at least one opening to permit water flow therethrough.

11. A foreign matter trap according to claim 10 in which said longitudinal member is pivotally affixed at its upper end to said top member.

* * * * *